United States Patent [19]

Tuuha

[11] Patent Number: 4,647,370

[45] Date of Patent: Mar. 3, 1987

[54] CHIP SCREEN WHOSE SCREEN BASKET HAS BEEN DIVIDED INTO TWO SECTIONS

[75] Inventor: Rolf Tuuha, Pori, Finland

[73] Assignee: Rauma-Repola Oy, Pori, Finland

[21] Appl. No.: 729,697

[22] Filed: May 2, 1985

[51] Int. Cl.[4] ..... B07B 1/28; B07B 1/34

[52] U.S. Cl. ..... 209/315; 209/332; 209/366; 209/415

[58] Field of Search ..... 209/332, 327, 311, 315, 209/316, 364, 365 C, 365 R, 366, 364, 44, 269, 270, 415; 366/219

[56] References Cited

U.S. PATENT DOCUMENTS

| | | | |
|---|---|---|---|
| 811,857 | 2/1906 | Leonard | 209/366 |
| 844,005 | 2/1907 | Drover | 209/366 |
| 1,123,167 | 12/1914 | Combs | 209/366 |
| 1,271,084 | 7/1918 | Schär | 209/366 |

FOREIGN PATENT DOCUMENTS

| | | | |
|---|---|---|---|
| 147483 | 2/1903 | Fed. Rep. of Germany | 209/366 |
| 291286 | 4/1916 | Fed. Rep. of Germany | 209/366 |
| 393406 | 2/1934 | Fed. Rep. of Germany | 209/332 |
| 257282 | 4/1970 | U.S.S.R. | 209/311 |
| 314481 | 9/1971 | U.S.S.R. | 209/311 |

*Primary Examiner*—Kenneth M. Schor
*Assistant Examiner*—Thomas M. Lithgow
*Attorney, Agent, or Firm*—Burns, Doane, Swecker & Mathis

[57] ABSTRACT

Chip screen whose screen basket has been divided into two basket sections (13, 14) that counter-balance each other and that are interconnected and operated by a vertically positioned revolving machine member, e.g. a crankshaft (15). Part (9) of one (14) of the basket sections is located above, and part (12) of it underneath, the center of cavity of the other basket section (13). Both of the basket sections (13, 14) may be supported by means of two support ropes (18, 19), whereby one support rope (18) of one basket section is connected with one support rope (19) of the other basket section by the intermediate of a balance (20) supported by its articulation point (21).

12 Claims, 4 Drawing Figures

CHIP SCREEN WHOSE SCREEN BASKET HAS BEEN DIVIDED INTO TWO SECTIONS

FIELD OF INVENTION

The present invention is concerned with a chip screen whose screen basket has been divided into two basket sections that counterbalance each other and that are interconnected and operated by a vertically positioned revolving machine member, e.g. a crankshaft.

BACKGROUND OF THE INVENTION

In the screening of wood chips, a high speed of the screening movement is aimed at, out of two reasons:

in order to increase the screening capacity, and in order to keep the screen planes open.

The remaining of the screen planes open is made more difficult by wood pieces and splinters that get stuck in the holes, as well as by sawdust that contains resin, moisture, snow, etc., which blocks the screen planes with the smallest holes and is deposited on the inner faces of the screen. By means of a sufficiently rapid screening movement, the said drawbacks can be reduced to a considerable extent, which increases the capacity of the screen indirectly further.

Another aim is a constant increase in the size of the screen.

In the screening of chips, the screening movement usually takes place in the horizontal plane, while the screen planes are slightly forwardly slanting. Almost without exception, the present-day chip screens are provided with counterweights, either in order to counterbalance the screening movement, or in order to produce the screening movement, by rotating the counterweights.

The movement needed for screening is produced by means of a vertical machine member (shaft, crankshaft or equivalent) revolving in the screen basket.

The highest speed of the screening movement is, as a rule, limited by the mass forces acting upon the bearings of the machine member concerned. Some of these forces are unavoidable (e.g. horizontal forces of the screen basket), some are not (e.g. horizontal and vertical forces of the counterweight).

OBJECT AND SUMMARY OF THE INVENTION

The object of the present invention is to avoid the counterweights mentioned above, which takes place by dividing the screen basket into two basket sections that counterbalance each other, and thereby to reduce the said mass forces. The screen in accordance with the invention is mainly characterized in that part of one of the basket sections is located above, and part of it underneath, the centre of gravity of the other basket section.

In a preferred embodiment of the invention, both of the basket sections are supported by two support ropes, whereby one support rope of one basket section is connected with one support rope of the other basket section by the intermediate of a balance supported by its articulation point. It is particularly advantageous if the crankshaft with its bearings is located symmetrically relative the horizontal center-of-gravity plane of the basket sections.

In pulp industry, on the wood barking, chipping and screening line, maximum capacity is aimed at, while the line comprises only one barking drum, chipper and screen. In respect of the barking drum and the chipper, the situation is that described above, but as regards screening of the chips, several screens with connecting conveyors are still used. This solution of screening is expensive, complicated, and requires a lot of space.

The capacity concerned corresponds to 800 to 1000 cubic metres stacked measure of chips per hour. A screen corresponding to this must have a large size (area of screen plate 30 to 35 sq. m.) and high speed of rotation (200 to 230 r.p.m.), which again results in high mass forces acting upon the bearings of the screen.

In the screen subject of the present invention the forces acting upon an individual bearing of the screen have been reduced by means of three component solutions as follows:

by avoiding the counterweights, weighing 500 to 1000 kilograms, which takes place by dividing the screen basket into two basket sections counterbalancing each other, in which said basket sections the conditions concerning the points of action of the forces and the center of gravity of the basket sections, to be described in the following, are carried into effect.

by avoiding axial forces in the journalling of the crankshaft, which takes place by supporting the basket sections by means of a self-balancing system of four support ropes.

by distributing the mass forces uniformly among the four bearings of the crankshaft, which takes place by placing the crankshaft with its bearings symmetrically relative the horizontal center-of-gravity plane of the basket sections.

Preferred embodiments of the present invention and their details will be described in more detail in the following with reference to the attached drawings, wherein FIG. 1 is a schematical side view of a screen known in prior art, FIG. 2 is a schematical side view of a screen in accordance with a preferred embodiment of the present invention, FIG. 3 is a schematical presentation of one mode of suspension of a screen basket in accordance with a first preferred embodiment of the present invention, and FIG. 4 is a schematical presentation of a second mode of suspension of a screen basket in accordance with a second preferred embodiment of the present invention.

DETAILED DESCRIPTION OF THE PREFERRED EMBODIMENTS

Figure 1:
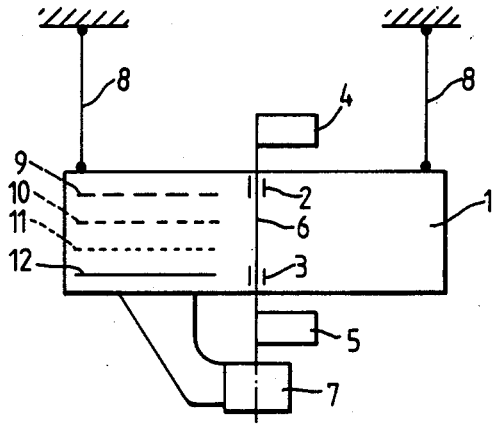
Fig. 1. PRIOR ART

FIG. 1 illustrates a conventional chip screen arrangement. A vertical shaft 6 provided with counterweights 4 and 5 is mounted to the center of the screen basket 1 by bearings 2 and 3, and the said shaft 6 is operated by a drive mechanism 7 supported on the screen basket. The screen basket, which is supported by its corners of four support ropes 8, is provided with screen planes 9, 10 and 11 as well as with a closed plane 12. The size of the holes in the screen planes becomes smaller when going downwards, and at the bottom there is the closed plane.

When the shaft 6 revolves, the screen basket 1 adopts a circular path of movement, wherein the screen basket 1 and the counterweight 4 and 5 counterbalance each other. It is a condition for smooth operation that the center of gravity of the screen basket 1 is on the shaft 6 and at the same level as the common center of gravity of the counterweights 4 and 5.

Figure 2:
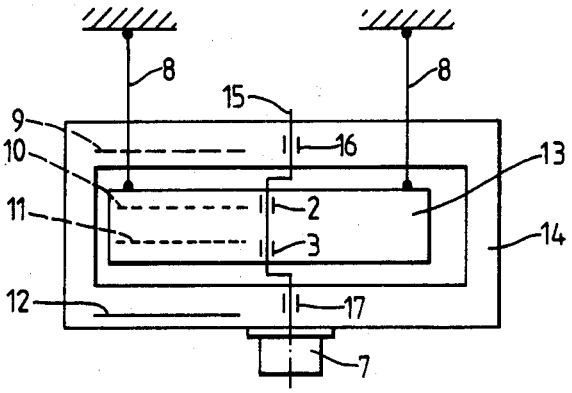

In the present invention, the starting point is in a screen arrangement in accordance with FIG. 1, by replacing the counterweights 4 and 5 by a unified basket section 14, whereas the other basket section 13 consists of the original screen basket 1, FIG. 2. The original shaft 6 is replaced by a crankshaft 15, which is mounted to the basket section 13 by bearings 2 and 3 and to the basket section 14 by bearings 16 and 17. The crankshaft 15 is operated by a drive mechanism 7 supported on the basket section 14. The screen planes 10 and 11 are placed in the basket section 13 and the screen plane 9 and the closed plane 12 in the basket section 14. Thereat, the screen plane 9 is located above the basket section 13, and the closed plane 12 is located below the basket section 13.

Under these circumstances, the basket section 14, which is attached to the basket section 13 by the intermediate of the crankshaft 15, has a rigid and continuous construction and extends to above and underneath the basket section 13.

If the journalling of the crankshaft 15 is axially bound to both of the basket sections 13 and 14, the screen basket combination formed by them is a completely rigid piece in the vertical direction. On the contrary, in the horizontal plane, the crankshaft 15 allows the free screening movement for the basket sections, but also a detrimental movement of turning around their journalling points. The turning movement is prevented by supporting each basket section by at least one support rope.

Figure 3:
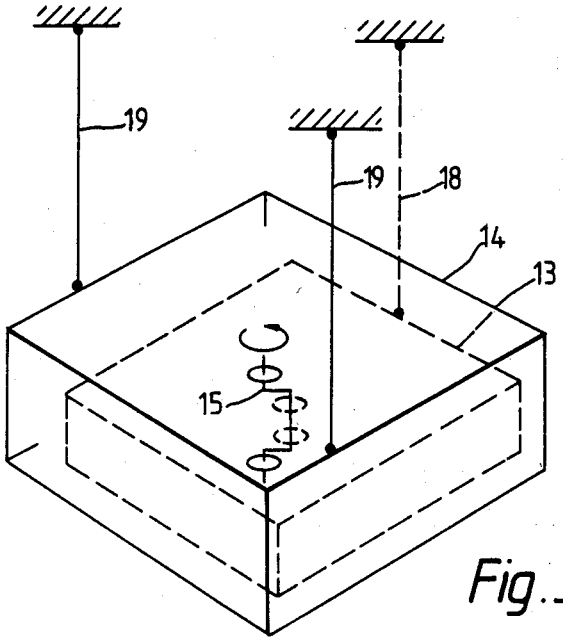

It comes from the above that the screen basket consisting of the basket sections 13 and 14 may be supported, at the minimum, by three support ropes (e.g., the basket section 13 by one rope 18 and the basket section 14 by two ropes 19), consideration being given to the stability of the center of gravity, FIG. 3.

Figure 4:
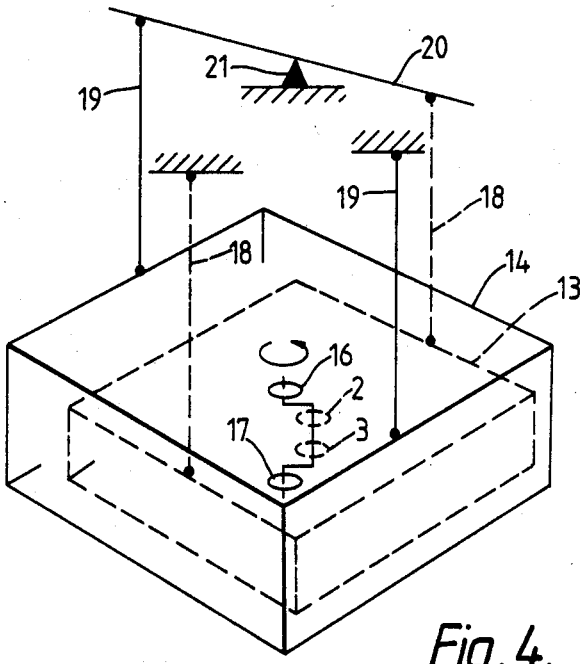

Vertical forces caused by the basket sections 13 and 14 on the crankshaft 15 bearings can be avoided by supporting the basket sections by four support ropes, as is shown in FIG. 4. Thereby, the basket section 13 is supported symmetrically relative its centre of gravity by two support ropes 18 and, correspondingly, the basket section 14 by two support ropes 19, so that the pairs of ropes 18 and 19 are placed crosswise relative each other. In view of equalizing the rope forces, one of the ropes 18 and one of the ropes 19 are interconnected by a balance 20, which is supported from an articulation point 21 chosen appropriately on the basis of the conditions of equilibrium of the balance 20.

Owing to the wide-area construction of the basket sections, it is also possible to distribute their load equally among several precisely adusted support ropes.

If, differing from the above, the crankshaft 15 is axially free in respect of one basket section, the lengths of the supporting ropes determine the relative vertical positions of the basket sections 13 and 14, while the journalling of the crankshaft 15 is thereat free from all axial forces.

It is a theoretical condition for a symmetric circular screening movement free from reaction forces:

1. that the center of gravity of the basket section 13 loaded with chips is on the vertical line determined by the bearings 2 and 3 and, correspondingly, the center of gravity of the basket section 14 is on the vertical line determined by the bearings 16 and 17, and that both of the centers of gravity are on the same horizontal plane.

2. that the force required in order to produce screening movement of the basket sections 13 and 14 loaded with chips is directed at the centre of gravity of the basket section concerned.

If the bearings 2 and 3, on one hand, and the bearings 16 and 17, on the other hand, are located, in the vertical direction, symmetrically relative the aforementioned centers of gravity, the radial forces acting upon the bearings 2, 3, 16 and 17 are equally high.

In practice, the rules of center of gravity given in sections 1 and 2 above cannot be followed completely, for example, owing to variations in the chip loads. The error concerned can, however, be kept so little that it is of no harm to the operation of the screen, i.e., expressed as centimeters, the horizontal distance of the center of gravity of a basket section from the vertical line defined in section 1 may be at the maximum 30 times the weight of the basket section as tonnes, and the vertical distance of the center of gravity of a basket section from the common center of gravity of the basket sections may be max. 3 times the weight of the basket section as tonnes.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A chip screen apparatus comprising a first basket section provided with an upper screen member and a lower closed plane member, said upper screen member and lower closed plane member being vertically spaced from each other, a second basket section provided with at least one screen member, said second basket section being located in the space between said upper screen member and said lower closed plane member so that said at least one screen member is located intermediate of said upper screen member and said lower closed plane member, means attached to said basket sections for supporting said first and second basket sections, said supporting means allowing relative motion to occur between said first and second basket sections, and a crankshaft drivingly connected to both of said first and second basket sections such that said crankshaft is rotatable about a vertical axis and said first and second basket sections counterbalance each other, whereby upon rotation of said crankshaft, relative motion is imparted to said first and second basket sections.

2. The chip screen apparatus as claimed in claim 1, wherein said means to support said first and second basket sections comprises at least one support rope attached to said second basket section and two support ropes attached to said first basket section.

3. The chip screen apparatus as claimed in claim 2, wherein said means to support said first and second basket sections comprises two support ropes attached to each of said basket sections, one support rope of said first basket section and one support rope of said second basket section connected to opposite arms of a balance member.

4. The chip screen apparatus as claimed in claim 1, wherein centers of gravity of the first and second basket sections are substantially on a common horizontal plane.

5. The chip screen apparatus as claimed in claim 1, wherein crankshaft bearings at locations on said first and second basket sections receive said crankshaft, said locations of each basket section located symmetrically relative to a horizontal center-of-gravity plane of the basket sections.

6. The chip screen apparatus as claimed in claim 2, wherein centers of gravity of the first and second basket sections are substantially on a common horizontal plane.

7. The chip screen apparatus as claimed in claim 3, wherein centers of gravity of the first and second basket sections are substantially on a common horizontal plane.

8. The chip screen apparatus as claimed in claim 2, wherein crankshaft bearings at locations on said first and second basket sections receive said crankshaft, said locations of each basket section located symmetrically relative to a horizontal center-of-gravity plane of the basket sections.

9. The chip screen apparatus as claimed in claim 3, wherein crankshaft bearings at locations on said first and second basket sections receive said crankshaft, said locations of each basket section located symmetrically relative to a horizontal center-of-gravity plane of the basket sections.

10. The chip screen apparatus as claimed in claim 4, wherein crankshaft bearings at locations on said first and second basket sections receive said crankshaft, said locations of each basket section located symmetrically relative to a horizontal center-of-gravity plane of the basket sections.

11. The chip screen apparatus as claimed in claim 6, wherein crankshaft bearings at locations on said first and second basket sections receive said crankshaft, said locations of each basket section located symmetrically relative to a horizontal center-of-gravity plane of the basket sections.

12. The chip screen apparatus as claimed in claim 7, wherein crankshaft bearings at locations on said first and second basket sections receive said crankshaft, said locations of each basket section located symmetrically relative to a horizontal center-of-gravity plane of the basket sections.

* * * * *